US006443442B1

(12) United States Patent
Willis et al.

(10) Patent No.: US 6,443,442 B1
(45) Date of Patent: Sep. 3, 2002

(54) EXTRACTION EQUIPMENT FOR PAPER MONEY

(75) Inventors: Marcus Willis; Andrew Brookman, both of Tunbridge Wells (GB)

(73) Assignee: Asahi Seiko Kabushiki Kaisha (JP)

( * ) Notice: Subject to any disclaimer, the term of this patent is extended or adjusted under 35 U.S.C. 154(b) by 42 days.

(21) Appl. No.: 09/656,591

(22) Filed: Sep. 7, 2000

(30) Foreign Application Priority Data

Sep. 9, 1999 (GB) ..... 9921355
Sep. 14, 1999 (GB) ..... 9921696

(51) Int. Cl.[7] ..... B65H 3/08
(52) U.S. Cl. ..... 271/11; 271/94; 271/106; 400/627; 414/797
(58) Field of Search ..... 221/5, 105, 106, 221/11, 94; 414/797; 400/627

(56) References Cited

U.S. PATENT DOCUMENTS 4,218,055 A * 8/1980 Krobel et al. ..... 271/106
4,457,512 A 7/1984 Stephenson
4,480,826 A 11/1984 Kaneko
4,506,876 A 3/1985 Nishibori
4,518,159 A * 5/1985 Nishibori et al. ..... 271/103
4,585,222 A * 4/1986 Nishibori et al. ..... 271/106
5,263,699 A 11/1993 Selak et al.

FOREIGN PATENT DOCUMENTS

| | | | |
|---|---|---|---|
| EP | 0 812 790 B1 | 12/1997 | |
| GB | 1 437 749 | 6/1976 | |
| GB | 1 487 433 | 9/1977 | |
| GB | 2 196 327 A | 4/1988 | |
| JP | 648140 A * | 1/1989 | ..... B65H/3/08 |
| JP | 8-188006 | 1/1998 | |
| WO | WO 86/0734 A1 | 12/1986 | |
| WO | WO 99/19033 A1 | 4/1999 | |

* cited by examiner

*Primary Examiner*—Donald P. Walsh
*Assistant Examiner*—Kenneth W Bower
(74) *Attorney, Agent, or Firm*—McGlew and Tuttle, P.C.

(57) ABSTRACT

A purpose of this invention is to provide paper money extraction equipment for issuing only one sheet of paper money by surely picking up the top most sheet from a stack in which a plurality of paper money sheets are arranged. The extraction equipment provides a suction box with an opening for adsorbing one sheet of paper money. The paper is moved when the paper money is taken up. A roller device issues the paper money which is taken up on this suction box. The extraction equipment suction box is pivoted at (52).

15 Claims, 13 Drawing Sheets

Fig. 7A
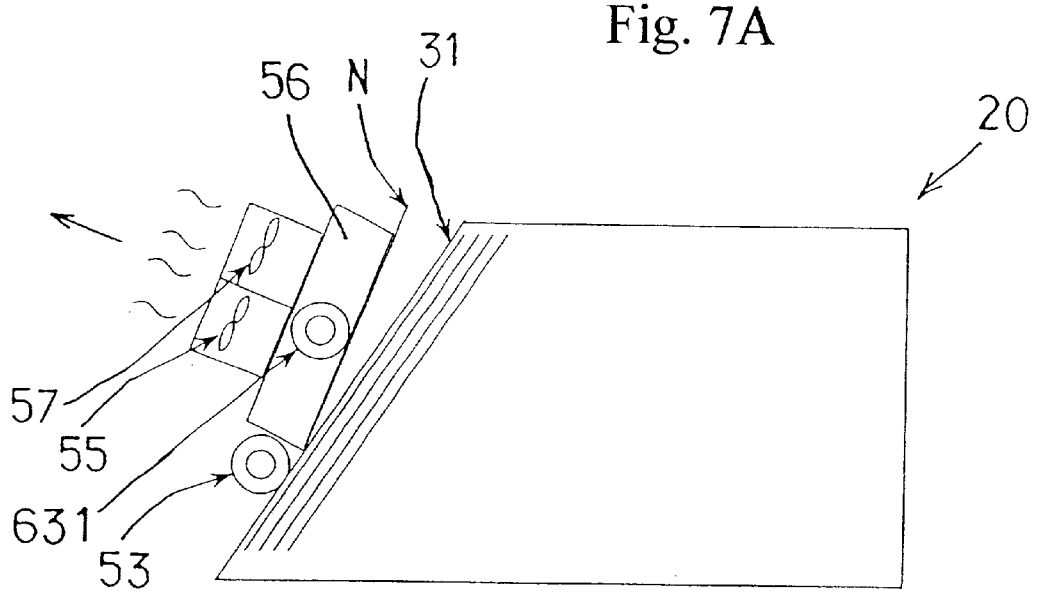
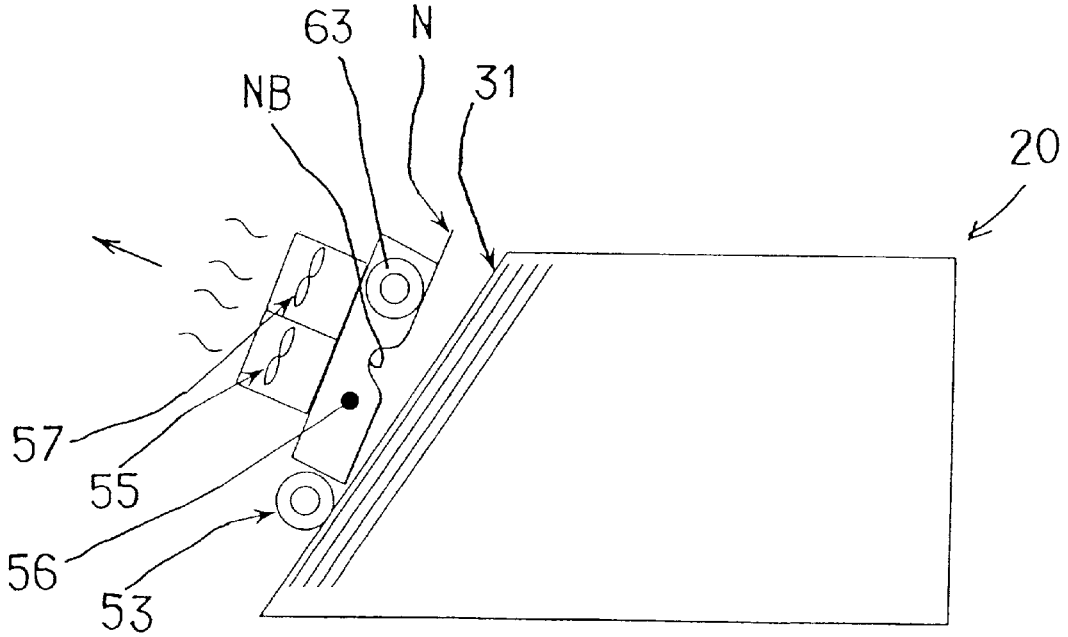
Fig. 7B

EXTRACTION EQUIPMENT FOR PAPER MONEY

FIELD OF THE INVENTION

This invention relates to a paper money extraction equipment for surely picking out only one sheet of paper money. More particularly, this invention relates to extraction equipment for picking out only one sheet of paper money from a plurality of stacked paper money sheets, especially equipment for sending out only the head paper money from the stack in which a plurality of paper moneys are arranged in standing state.

Such equipment may of course be used by itself or this extraction equipment may be used as a part of a paper money paper money dispenser. This equipment can be used for paying for goods, exchanging money for tickets, trading tickets, scrip or other value sheets. The term "paper money" in this specification also refers to goods, trade tickets, simulation paper moneys or other securities, etc. In other words the term "paper money" in this specification relates to sheet bodies in general.

BACKGROUND OF THE INVENTION

Sheet paper money dispensers for issuing sheet bodies including paper moneys have been proposed in various types. For example, there is an invention described in Japanese Patent Application 8-188006 in the name of this applicant (also disclosed in European Patent EP 0 812 790 B1). This invention concerns a paper money dispenser for sheet bodies. This paper money dispenser is summarily shown on the attached FIGS. 10A and 10B and 11A and 11B.

As shown on B of FIG. 10, negative pressure is generated at an opening 22, when a fan suction device 26 is driven. As this result, the top most sheet body S1 will be adsorbed on the opening 22. In the above-mentioned condition, a small tire 27 is rotated via existing belt 31, etc., when electric motor 29 is driven. Thus, sheet body S1 which is taken up on opening 22 is sent out to the direction of an exit 14 by the frictional force of tire 27 (refer to FIG. 11A). The tip of sheet body S1 which is sent out to the direction of exit 14 is sandwiched between paired rollers 16 and 17. When sheet body S1 is located between rollers 16 and 17, the sheet body S1 is drawn and paid out to the outside direction (refer to FIG. 11B).

However, there was a problem that the paper money dispenser lacked in providing certainty as to issuing the sheet body paper money. In other words, there was a problem that the paper money dispenser could not issue one sheet of paper money surely. This was related to the problem that delivering tire 27 for paper money idled at the case of bent paper money.

SUMMARY AND OBJECTS OF THE INVENTION

It is an object of this invention to offer paper money extraction equipment for issuing only one sheet of paper money by surely picking out the sheet.

Especially, a purpose of this invention is to surely pick out only the head most paper money sheet from the stack in which a plurality of paper money sheets are arranged in a standing state.

According to the invention, sheet paper money extraction equipment is provided comprising at least a suction box having an opening for adsorbing one sheet of paper money. The suction box is moveable for being moved when the paper money is taken up. A roller device issues the paper money which is taken up on this suction box.

The suction box may be pivoted at a rotating shaft. The suction box may have a fan to generate the vacuum (negative pressure).

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 7A is schematic view for explaining this embodiment;

FIG. 7B is schematic view for explaining the embodiment of FIG. 6;

DESCRIPTION OF THE PREFERRED EMBODIMENTS

Figure 1:
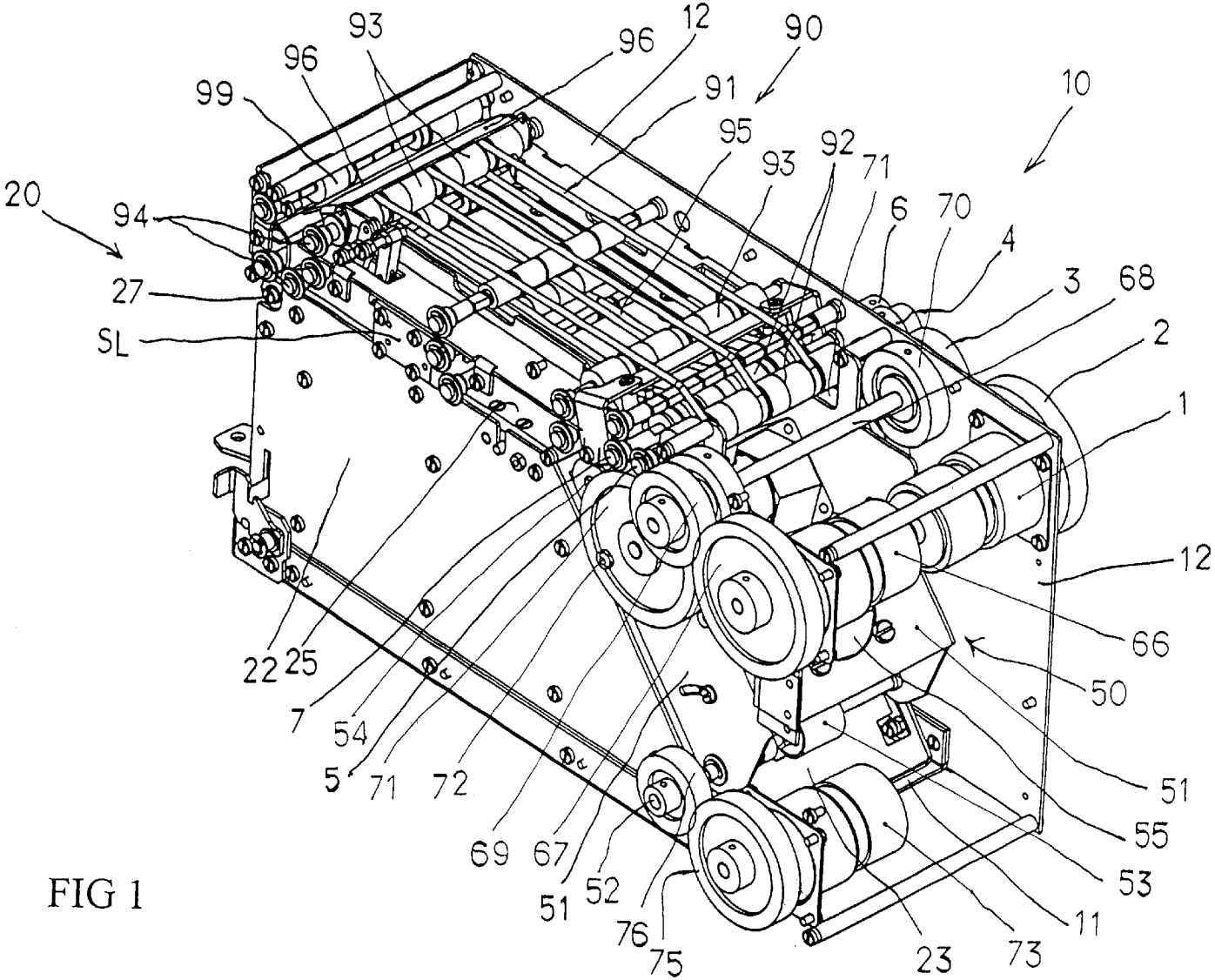
FIG. 1 is a perspective view, with a side wall omitted, which shows a paper money dispenser for paper money according to an embodiment of this invention.
Figure 2:
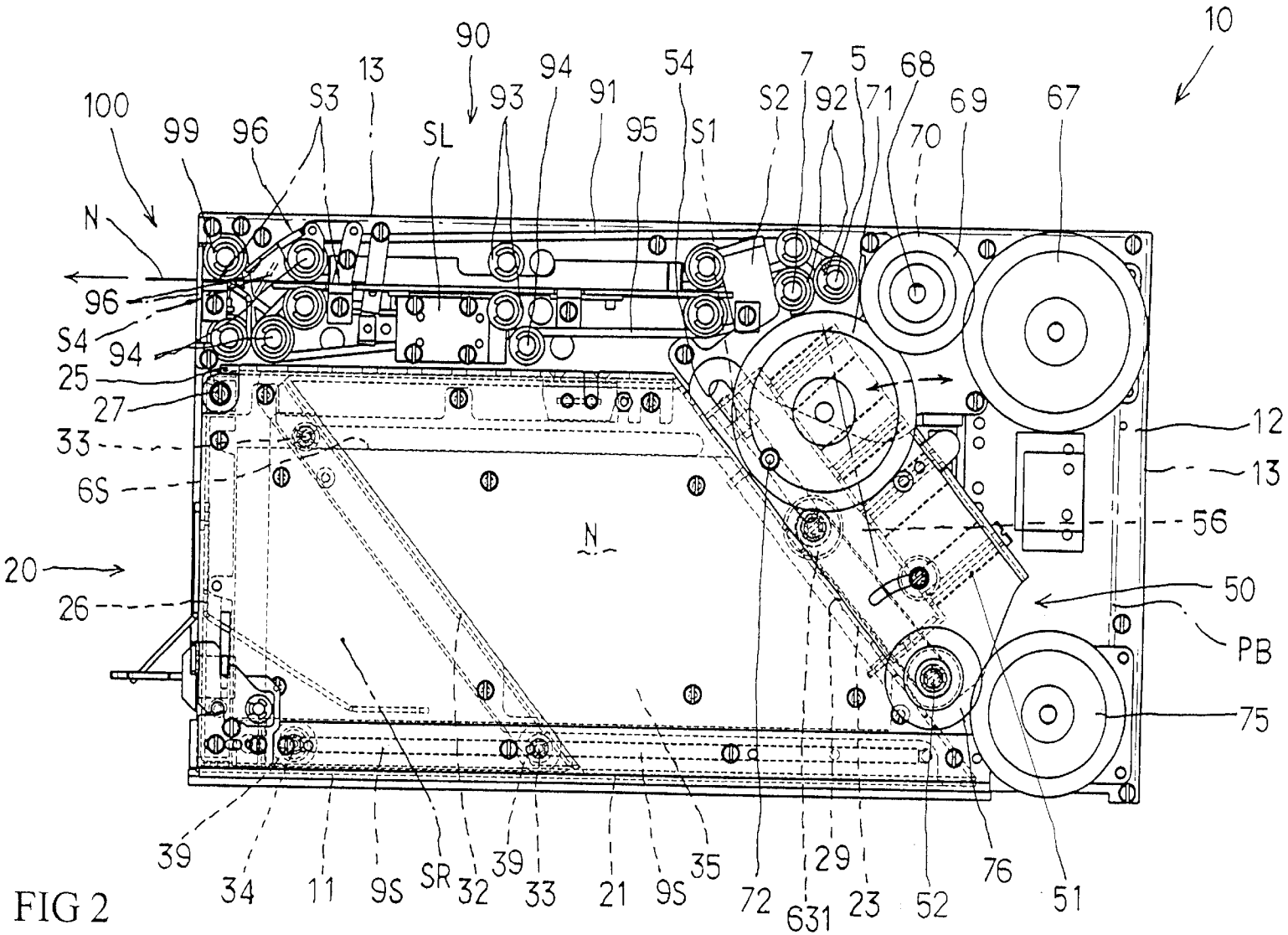
FIG. 2 is an end view in which the paper money dispenser of FIG. 1 is viewed from the left side.

Referring to the drawings in particular, a large rectangular parallelepiped shaped a paper money dispenser 10 for paper money is shown on the whole in FIG. 1. Paper money dispenser 10 has a rectangular base plate 11 and large side walls 12. The walls 12 respectively stand up at each side of this base plate 11. In FIGS. 1 and 2 respectively, only one of rectangular side walls 12 is shown. Between paired side walls 12, a large L-shaped cover plate 13 is installed, covering from the top to the right margin (see FIG. 2).

Within the paper money dispenser 10, a paper money cassette 20 is stored (from the center, under to the left side). Cassette 20 has a snowplow shape, as shown on FIG. 3. This equipment 20 has a rectangular base plate 21 and trapezoidal side walls 22 that respectively stand up at each side of this base plate 21. At tip front part between paired side walls 22, a window plate 23 is obliquely fixed (refer to FIG. 3). At the top between paired side walls 22, a rectangular lid plate 25 is placed to freely open. Further, at the rear between paired sides plate 22, a little small end plate 26 is placed to freely open. At the upper end of end plate 26, a part of lid plate 25 is pivoted at 27. There is an angle of about 50 degrees from window plate 23 to base plate 21.

Figure 4A:
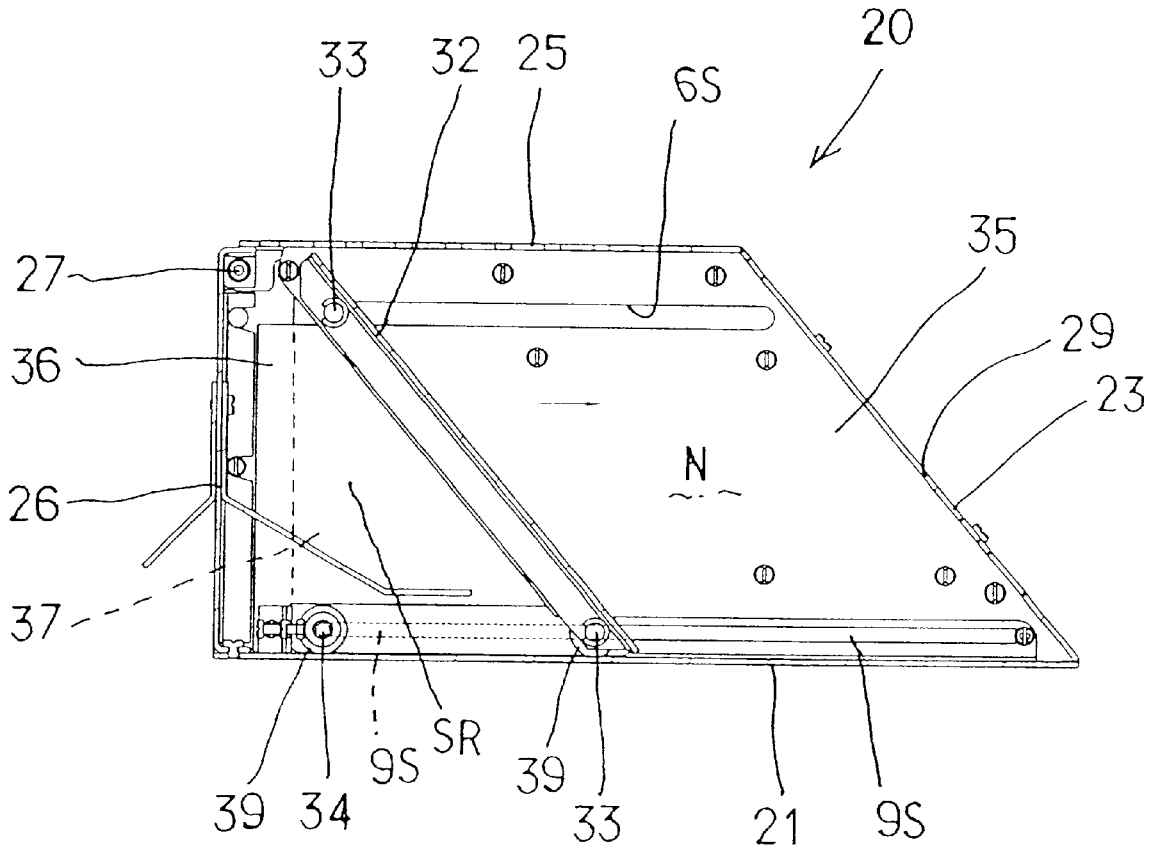
FIG. 4A is a sectional view of the cassette of FIG. 3.

Window plate 23 has a large opening 29 at the upper half. Through this large opening 29, paper money N is drawn. At each upper part corner of the opening 29, tab 31 is formed respectively. These tabs 31 respectively retain each corner upper part of the paper money N inside. Inside of cassette 20, a pressure plate 32 for pressing a plurality of paper money sheets N is arranged to slide freely. The pressure plate 32 is a size which is made to the length of the paper money N. The pressure plate 32 is obliquely placed against base plates of 21 (refer to FIG. of 4A). At the upper and lower ends of pressure plate 32, the shaft rod 33 respectively penetrates into the area of paper money sheets N. Further, on each side of slideable pressure plate 32, a rhombic and thin partition 35 is respectively placed (refer to FIG. 4A).

Figure 4B:
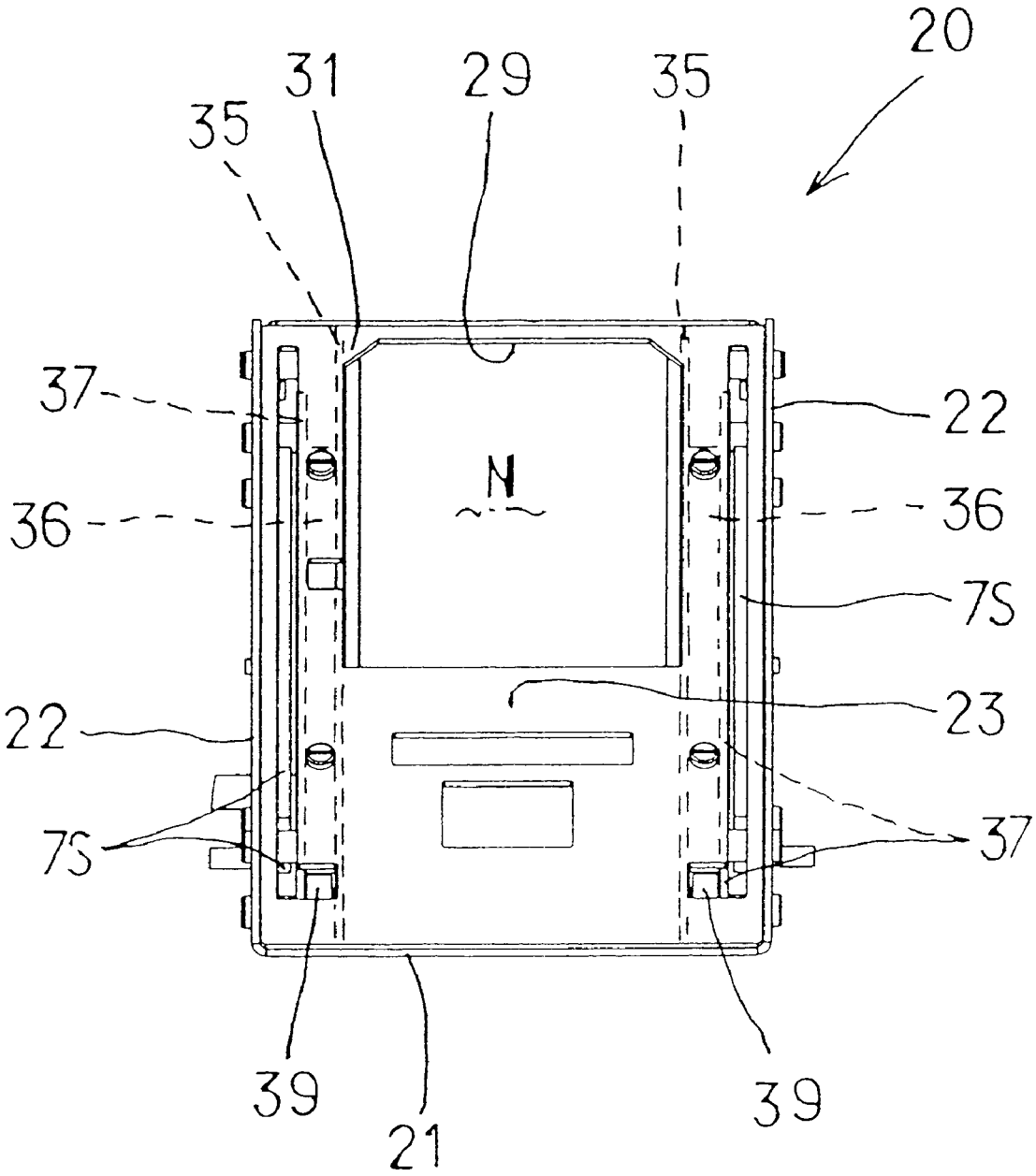
FIG. 4B is a front elevation view of a cassette of FIG. 4A.

By positioning a trapezoidal thick plate 36, which is made of resin, each partition 35 is fixed in cassette. On each outside edge of shaft rods 33, on pressure plate 32, each of paired thin tripod plates 37 is fixed, respectively. The thin tripod plates 37 have a right-angled triangle shape. These paired tripod plates 37 are placed at the outsides of thick plates 36, and are fixed on the edges of shaft rods 33, respectively. At rectangular portions of the tripod plates 37, a rod shaft 34 is provided. On this shaft rod 34 and the bottom shaft rod 33, rollers 39 are arranged running along base plate 21. Between each projection edge of lower shaft rod 34 and each tip of side walls 22, each of springs 9S are respectively arranged. On the upper parts of these tension springs 9S, spacers 7S, which are made of resin, are respectively been placed (refer to FIG. 4A and 4B). Spacers 7S are respectively fixed on side walls 22. At each upper part of paired partitions 35, lateral length slots 6S are formed (refer to FIGS. 2 and 4). In each slot 6S, each edge of upper shaft rod 33 on pressure plate 32 is respectively inserted to slide freely.

Figure 5:
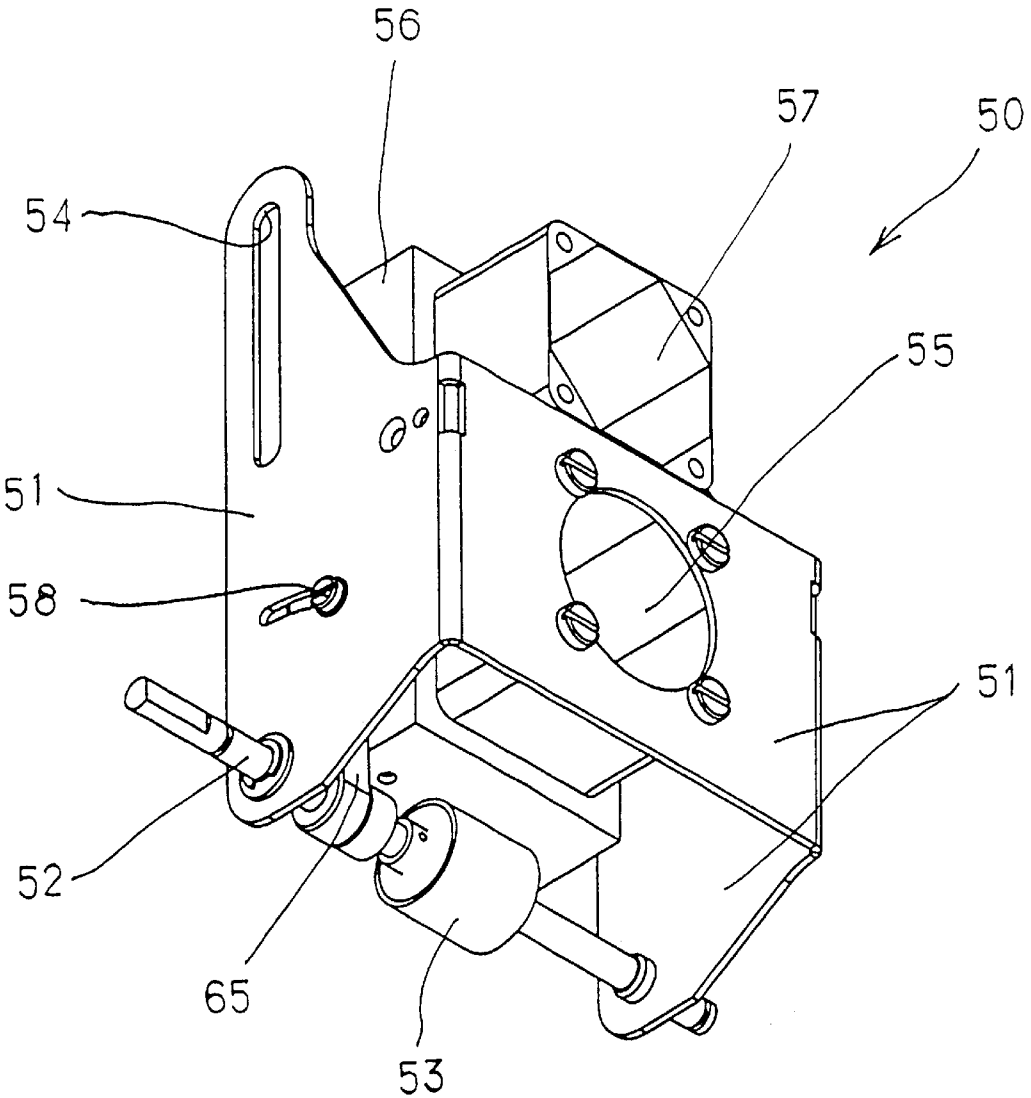
FIG. 5 is a perspective view in of an embodiment of a main section viewed from below.
Figure 6:
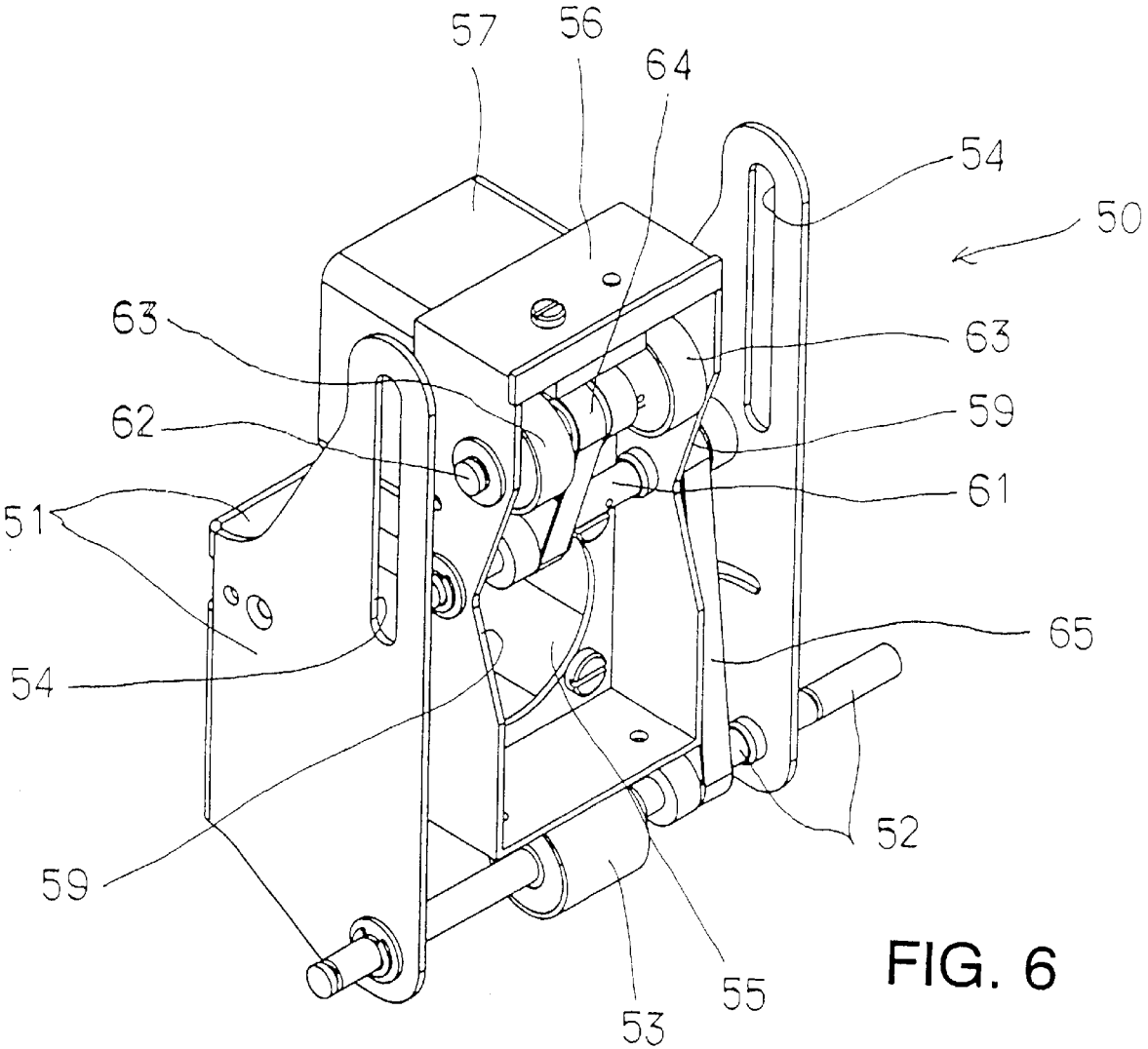
FIG. 6 is a perspective view of the main section of FIG. 5 viewed from the back side.

As shown on FIG. 2, at the right inside of paper money dispenser 10, a paper money extraction mechanism 50 is positioned to rise freely. A main portion of extraction mechanisms 50 is shown in FIGS. 5 and 6. As shown on FIG. 5, extraction mechanism 50 has a U-shaped frame 51. Each edge of frame 51 is formed a little longer at the top and bottom, and at each lower end, a rotating shaft 52 is inserted. Frame 51 is mounted to rotate freely around the rotating shaft 52. At the central of rotating shaft 52, a friction primary roller 53 is fixed for issuing paper money N. Within the center of U-shaped frame 51, a primary fan 55 is fixed. A suction box 56, which is a long angle-barrel in an upright position is fixed on fan 55. In addition, on the upper part of suction box 56, a second fan 57 is fixed. Although the bottom fan 55 and the top fan 57 are paired, one fan may be omitted. A large oblong air intake opening 56A of suction box 56 is disposed to adsorb an oblong paper money sheet N (refer to FIG. 7). At the center of oblong opening edges 56 B of suction box 56, each of two recess 59 is respectively formed (refer to FIG. 6). At the central portion of oblong suction box 56, a horizontal axle 61 is inserted to rotate freely. In addition, at the upper part of suction box 56, a short rotating shaft 62 is inserted to rotate freely. At both sides of rotating shaft 62, second friction rollers 63 are respectively fixed for issuing paper money N. Rotating shaft 62 is linked with horizontal axle 61 via intervening a belt 64. A projection edge of horizontal axle 61 is linked with rotating shaft 52 via intervening a belt 65. As a result of this arrangement, rotating shaft 52 rotates rollers 53 and 63 at each of the top and bottom. Shaft 58 at the left center of FIG. 5 is an adjustment roller shaft for stretching belt 65.

The operation of suction box 51 is controlled by an electric motor 66 which is shown at the right center on FIG. 1. Electric motor 66 has been combined with a large drive gear 67 which is placed outside of side plate 12 (not shown). Drive gear 67 engages with gear 69. Gear 69 is fixed on the left end of a rotating shaft 68 which extends between paired side walls 12. On each side of this long rotating shaft 68, each gear 70 is fixed, respectively. Each gear 70 engages with each large gear 71, respectively. Each gear 71 is pivoted at the inside of each side plate 12. Thus, when electric motor 66 is operated, drive gear 67 and gears 69 and 70 and large gear 71 are rotated. Large gear 71 has a bolt 72 which slides in slot 54 of frame 51 (refer to FIG. 2). Therefore, when gear 71 revolves once, frame 51 is reciprocated in one cycle. When gear 71 is revolved one time, frame 51 moves against window plate 23 of cassette 20. By the rotation of paired gears 71, a part of pick-up mechanism 50 makes the motion around the rotating shaft 52. Rollers 53 and 63 of top and bottom, for paper money delivery, are controlled by electric motor 73 which can turn in a forward and a backward direction (refer to the right lower part of FIG. 1). On the rotating shaft of electric motor 73, which rotates freely as it extends into side plate 12, a drive gear 75 is fixed. This drive gear 75 engages with gear 76 which is fixed on the outside end of rotating shaft 52. Accordingly, when electric motor 73 is rotated in a forward or a backward direction, rollers 53 and 63 of the top and the bottom are rotated in a positive or a reverse direction.

A paper money transfer mechanism 90 is placed on the upper portion of cassette 20, as shown on FIG. 1. The transfer mechanism 90 is stationed across from the central top of paper money dispenser 10 to the left side thereof (refer to FIG. 2). Transfer mechanism 90 carries the paper money N from the extraction mechanism 50 to a disposition mouth 100 on dispenser 10. This transfer mechanism 90 is driven by a reversible electric motor 1 which is shown at the right upper part of FIG. 1. Electric motor 1 rotates a large drive gear 2 which is placed outside of side plate 12. Drive gear 2 engages with a stepped gear 3, which is installed freely rotatable on the outside end of shaft rod 68. Stepped gear 3 engages with a stepped gear 4 which is fixed on a driving shaft 5 between side walls 12. Stepped gear 4 further engages with a gear 6 which is fixed on a driving shaft 7 between side walls 12. Driving shafts 5 and 7 are inserted freely rotatable into paired side walls 12, respectively. On driving shafts 5 and 7, a plurality of driving rollers 92 are fixed, respectively. In addition, between paired side walls 12, extending to disposition mouth 100, a plurality of rotating shafts 94 are inserted freely rotatable. On these rotating shafts 94, a plurality of idlers 93 are fixed, respectively. The upper portion of transfer mechanism 90 is provided with a set of large O-rings, namely belts 91. These belts 91 are expanded around driving roller 92 and a plurality of idlers 93. The lower portion of transfer mechanism 90 is also provided with a set of large O-rings, namely belts 95. These belts 95 are also expanded around driving roller 92 and a plurality of idlers 93. Belts 91 and 95 form a transfer path therebetween, where paper money N is transported to dispensing mouth 100. Near dispensing mouth 100, a re-curving plate 96 for changing the direction of transported paper money N is pivoted (refer to the left side on FIG. 1). This re-curving plate 96 is controlled by a solenoid SL which is fixed on side walls 12. Re-curving plate 96 is generally in the solid line position on FIG. 2, under the force of the bias of the spring. When the solenoid SL is ON, it is rotated to the chain line position oi FIG. 2. When re-curving plate 96 is rotated into the chain line position of FIG.2, paper money N is turned to a storage room SR of cassette 20 (refer to FIG. 2). The paper money N is stored to the left side of pressure plate 32, by intervention of a slot 24, which is on a top plat 25 of cassette 20. Near dispensing mouth 100 a plurality of rollers 99 are provided. These rollers 99 are driven by a belt (not shown), via a pulley on gear 4 (see FIG. 1).

The paper money dispenser 10 has a plurality of sensors, in order to monitor the passage of paper money N. A primary sensor S1 is of infrared-reflection type. It is installed on the upper part within suction box 56 (refer to FIG. 2). This sensor S1 detects whether there is a paper money N in cassette 20 or not. In addition, this sensor S1 detects whether the paper money N is picked up or not by the extraction mechanism 50. A second sensor S2 is of infrared-reflection type. It is arranged at the upper part of extraction mechanism 50 (refer to FIG. 2). This second sensor S2 detects whether the paper money N is extracted by extraction mechanism 50 to transfer mechanism 90. In addition, this sensor S2 detects whether the paper money N which was extracted by extraction mechanism 50 to transfer mechanism 90 is a single sheet or not. Third sensors S3 are of infrared-reflection type. They are arranged in the front of and behind deflecting plate 96 (refer to FIG. 2). These sensors S3 detect the paper money N which passes dispensing mouth 100. A fourth sensor S4 is of infrared-reflection type. This sensor S4 is installed below sensor S3 (refer to FIG. 2). This fourth sensor S4 detects the paper money N which has had its direction changed by the re-curving plate 96 towards the storage room SR.

The control on paper money dispenser 10 is via a printed circuit board PB which is fixed between side walls 12 (refer to the right on FIG. 2). The paper money dispenser 10 is controlled by the microprocessor (not shown) on printed circuit board PB.

Figure 8:
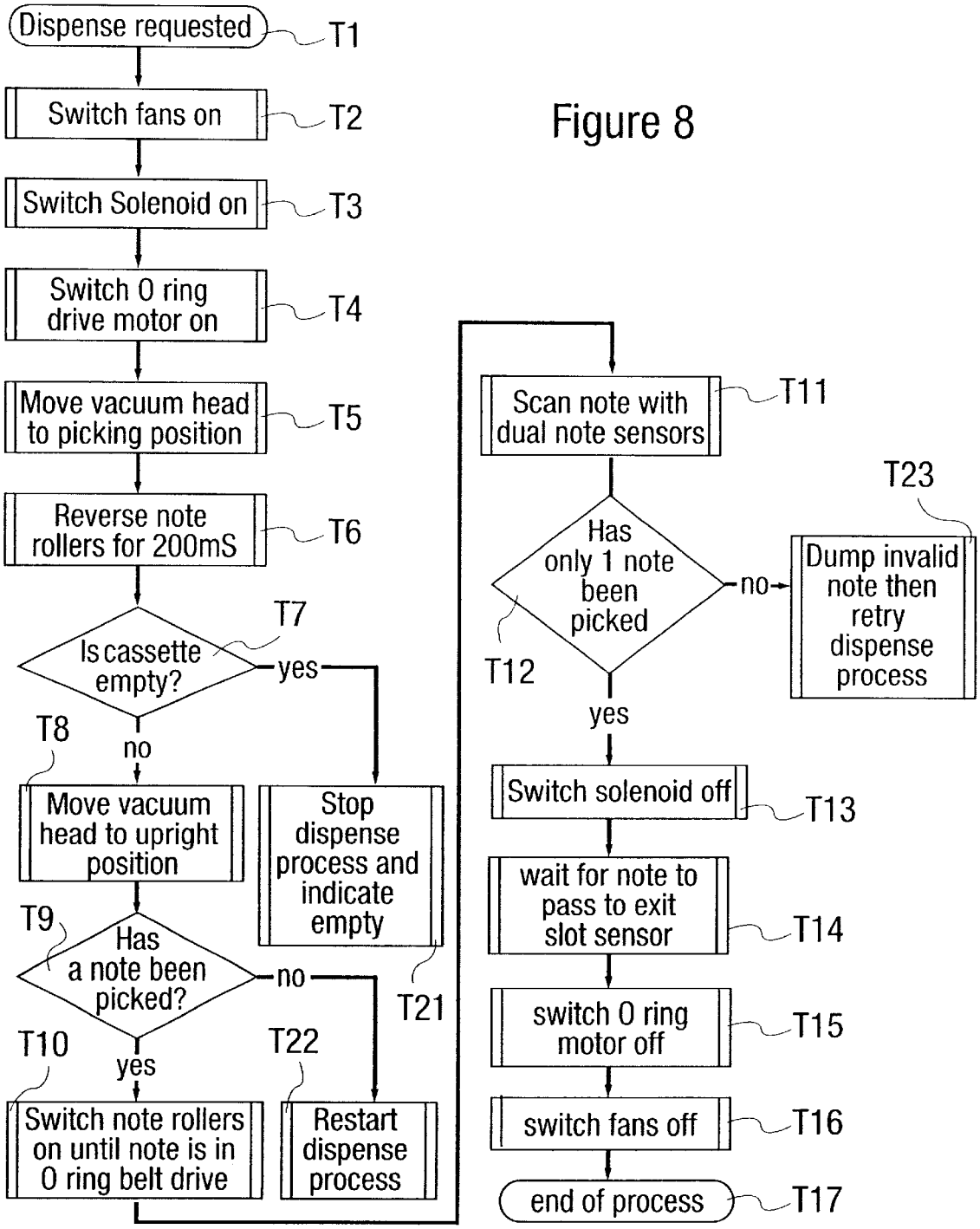
FIG. 8 is a flow chart for explaining the operation of the paper money dispensing machine of FIG. 1.

The paper money dispenser 10 for paper money may be used, for example, as shown on the flow chart of FIG. 8. To begin with, by electric signals are generated (via a button switch (not shown) and similar actuation) and paper money N dispensing is required (step T1). When the paper money N dispensing is required, the microprocessor on printed circuit board PB drives fans 55 and 57 (step T2). Fans 55 and 57 are operated, and negative pressure is generated in the suction box 56 for paper money. Next, the microprocessor makes solenoid SL switch ON and prepares for the paper money dispensing (step T3). In addition, the microprocessor switches on the electric motor I so that transfer mechanism 90 may operate (step T4). Then, electric motor 66 is further operated, and extraction mechanism 50 is moved to the position as shown on FIG. 2 (step T5). Thus, the top most paper money sheet N of stacked paper moneys is taken up at the large opening of suction box 56. The top most paper money sheet N in cassette 20 is taken up through the opening 29. Next, electric motor 73 is operated, and rollers 53 and 63 at top and bottom are reversely turned for 200 milliseconds (step T6). When rollers 53 and 63 are reversed, the paper money N which is taken up through openings 29 and 29A is lowered a little. As this result, each upper corner of paper money N which is taken up on suction box 56 will come off from each of the tabs 31. At this time, this drawn paper money sheet N is provided with a deflection NB by reverse turn of rollers 63 and negative pressure action (refer to FIG. 7B). By this deflection NB of the sheet, the taken up paper money N will be surely separated from paper moneys N in cassette 20. The deflection NB of paper money follows paired recesses 59 which are formed at the opening of suction box 56 (refer to FIG. 6). When there are no paper money sheets N in the cassette 20, when the cassette 20 is empty, there is no paper money N at the opening of suction box 56. Sensor S1 within suction box 56 detects that paper money N does not exist at the opening of suction box 56 (step T7). When there is no paper money N in cassette 20, the paper money dispensing operation is stopped (step T21). When there is paper money N is in cassette 20, electric motor 66 is further operated. As a result, suction box 56 is rotated to the position of a standing condition, as shown on FIG. 7 (step T8). Sensor S1 within suction box 56 detects whether paper money N is surely picked up (step T9). When there is no sure extraction of paper money, the above process is repeated (step T22). When one sheet of paper money N is surely picked up, electric motor 73 is rotated (step T10). Rollers 53 and 63 are rotated in order, and then the taken up paper money N is sent out above. As this result, a paper money sheet N which is suctioned on suction box 56 is sent out to the driven transfer mechanism 90. When paper money N is sent out to transfer mechanism 90, the electric motor 73 is stopped (step T10). In the meantime, the paper money N which is sent out to transfer mechanism 90 is scanned by sensor S2 at the upper part of extraction mechanism 50 (step T11). The signal from sensor S2 is monitored, and then it is detected whether one sheet of paper money N is surely sent out or not (step T12). When one sheet of paper money N is surely sent out, solenoid SL is then switched off (step T13). Re-curving plate 58 is returned to the continuous line position which is shown on FIG. 1, by the spring bias. Thus, the feed of paper money N to the dispensing mouth 100 is monitored by two sensors S3 (step T14). When paper money N is issued from dispensing mouth 100 (e.g., via human fingers, etc.), the electric motor 1 of transfer mechanism 90 is made to switch-off (step T15). Then, the fans 55 and 57 are made to switch-off (step T16). The operation of paper money paper money dispenser 10 in which this embodiment is built is ended (step T17). If somehow more than one sheet of paper money N sent out, solenoid SL is kept to be energized by the detection of sensor S2. As this result, these paper moneys N are turned to the storage room SR by re-curving plate 58. Then, the above-mentioned dispensing process is tried again (step T23).

The primary practical example of paper money extraction mechanism 50 is shown in FIG. 2 and is shown schematically in FIG. 7A. This primary practical example has rollers 631 at the central of suction box 56, and these rollers are fitted into opening 29 (refer to FIG. 2). When rollers 631 are reversed, the taken up paper money N through opening 29 is lowered a little. As this result, each upper corner of paper money N which is taken up on suction box 56 will come off from each tab 31 (refer to FIG. 7A). A second practical example of paper money extraction mechanism 50 is shown in FIGS. 5 and 6 and schematically in FIG. 7B. This second practical example has rollers 63 at the upper part of suction box 56, and these rollers 63 are fitted into opening 29. When rollers 63 are reversed, the taken up paper money N through opening 29 is lowered a little. As this result, each upper corner of taken up paper money N on suction box 56 will be come off from each tab 31. At this time, the drawn paper money N is formed with a deflection NB by negative pressure action and reverse turn of rollers 63 (refer to FIG. 7B). The deflection NB of paper money follows paired recesses 59 which are formed at the opening of suction box 56 (refer to FIG. 6). By this deflection NB of paper money, the taken up paper money N will be surely separated from paper moneys N in cassette 20. In other words, the extraction mechanism of second practical example (FIG. 7B) has the further advantage as to sheet extraction as compared to the primary practical example of FIG. 7A.

In this practical example, the opening of suction box 56 is formed as a rectangular tubular part which extends uprightly. However, it is of course possible that the opening of suction box 56 is of a tubular form, which is square or elliptic, etc. Roller 53 is used in this practical example. However, it is of course possible to use a small tire or slender belt, etc. In this practical example, suction box 56 was moved around rotating shaft 52. However, it is of course possible for suction box 56 to be moved in a horizontal direction or perpendicular direction, etc. In this practical example, suction box 56 has directly fans 55 and 57 as a negative pressure source. However, it is of course also possible that other suction/vacuum sources may be provided, such as a syringe, to be used instead of fans 55 and 57. It is of course also possible that a suction tube, etc. is used and will be connected with a separated negative pressure source.

Figure 3:
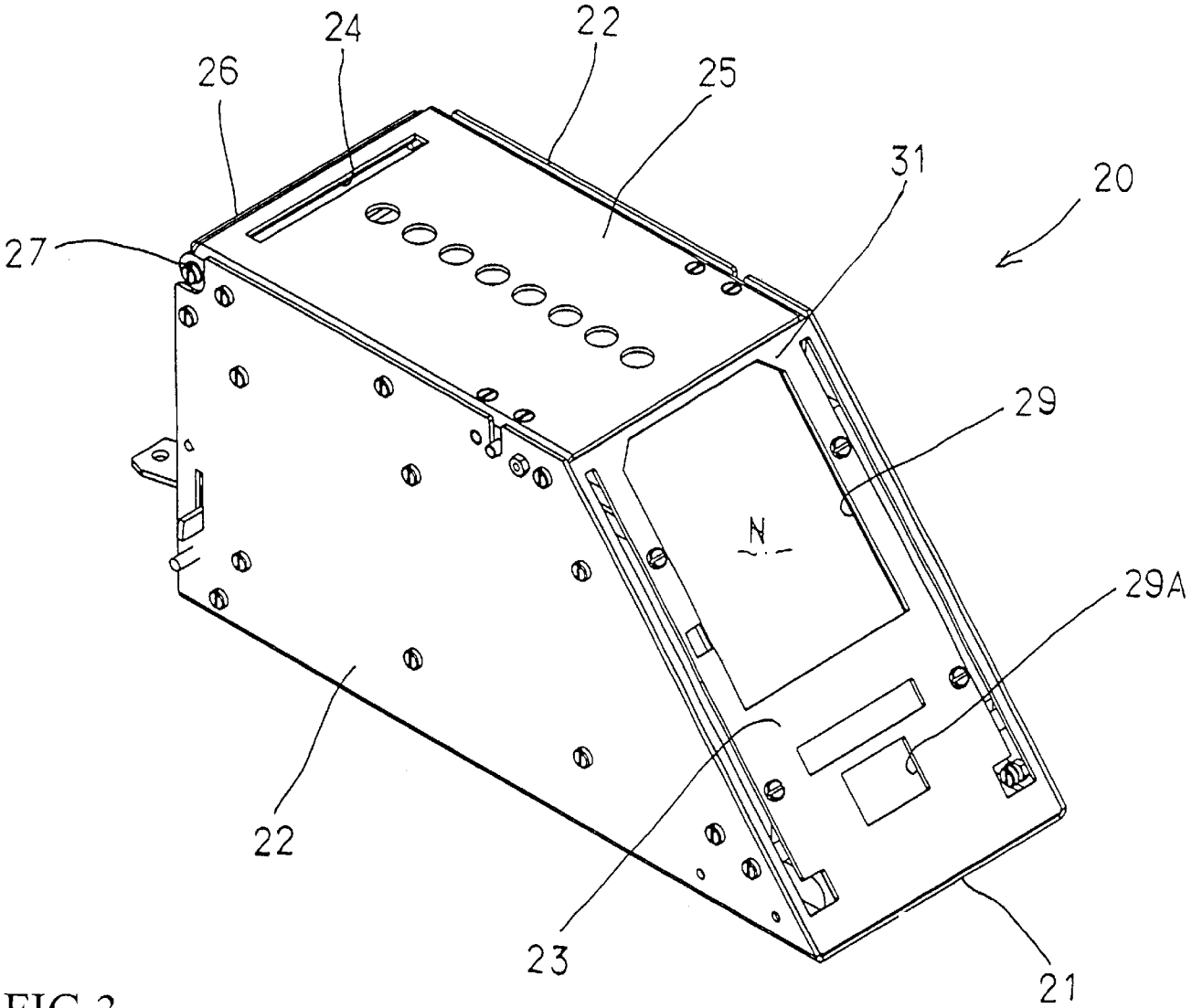
FIG. 3 is a perspective view which shows a paper money cassette, which is stored in inside of the paper money dispenser.

FIG. 9 shows an embodiment of the case in which a shutter mechanism is added to cassette 20 of FIG. 3. Cassette 201 of FIG. 9 wholly has a shape like a snowplow, almost the same as FIG. 3. Cassette 201 has a rectangle base plate 21 and trapezoidal side walls 221 which stand up at each side of the base plate 21, respectively. Inside of each side plate 221, a slot ST is respectively formed along a hypotenuse division to surface division. The illustrated long slot ST is a groove. However, it is of course also possible that it may be an open hole. At the downward of paired slots ST on the hypotenuse divisions of side walls 221, a window plate 23 is obliquely fixed. Also, at the downward side of paired slots ST on the surface divisions of the side walls 221, a rectangle lid plate 25 is placed to open freely. At the rear, between paired side walls 221, an end plate 26 is placed to open freely. At the upper end division of end plate 26, an end part of lid plate 25 is pivoted at 27, in a manner similar to FIG. 3. Also, at the surface divisions of paired side walls 221, a rectangular cover plate 251 is pivotable, in a lock free manner for example. It is of course possible for the slot 241 for paper money recovery to be formed at the rear end division of this cover plate 251. Between paired long slots ST, a freely bendable shutter S is fitted in, in a slide free manner. Shutter S has a plurality of slender plates P which are long and are flat and they are arranged at even state These slender plates P have a slender rod R installed in each. Each end of slender rods R is freely slidable inserted into each slot ST on side walls 221, respectively. Still, though the illustration was omitted, a plurality of slender plates P are freely bendably connected to each other. For example, neighboring slender plates P are hinged with each other by thin shafts and small links (not shown). When a plurality of slender plates P are made of a resin molded product, it is possible that adjoining slender plates P are hinged and integral.

Figure 9A:
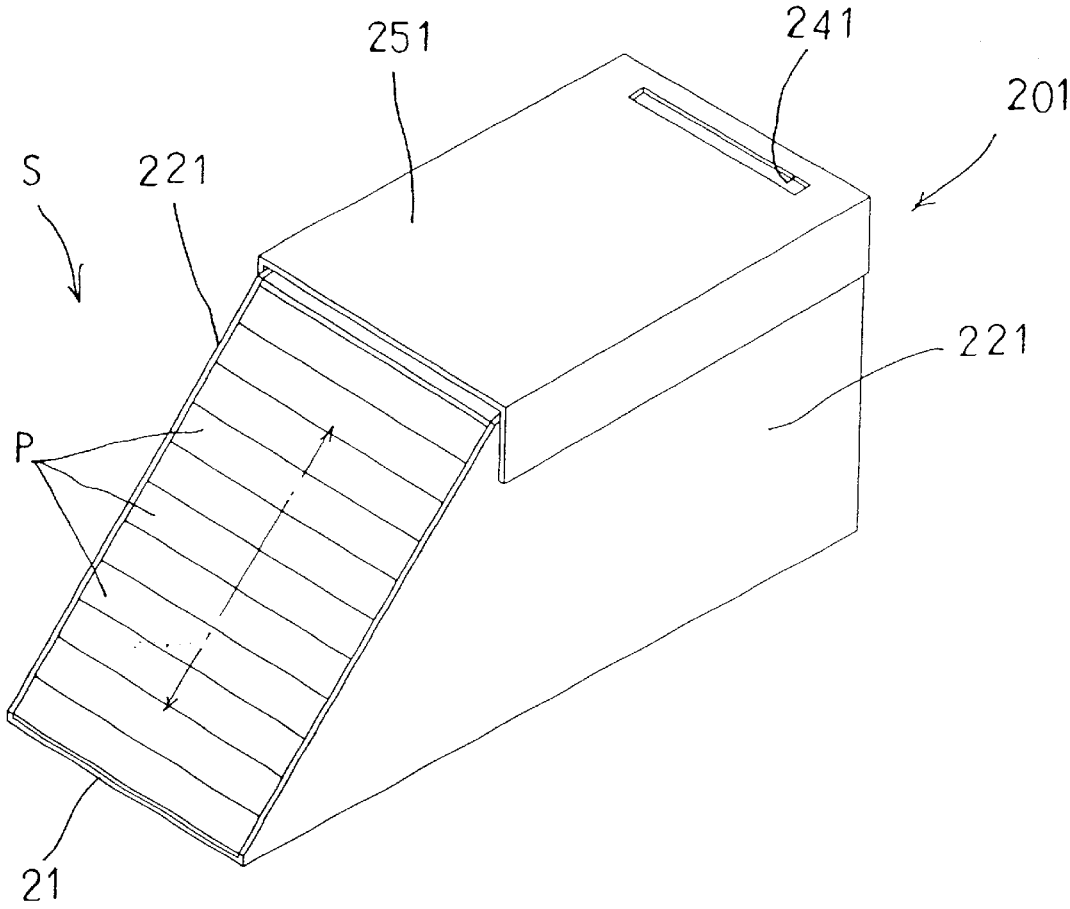
FIG. 9A is perspective view which show another paper money cassette, which is stored inside of the paper money dispenser of FIG. 1.
Figure 9B:
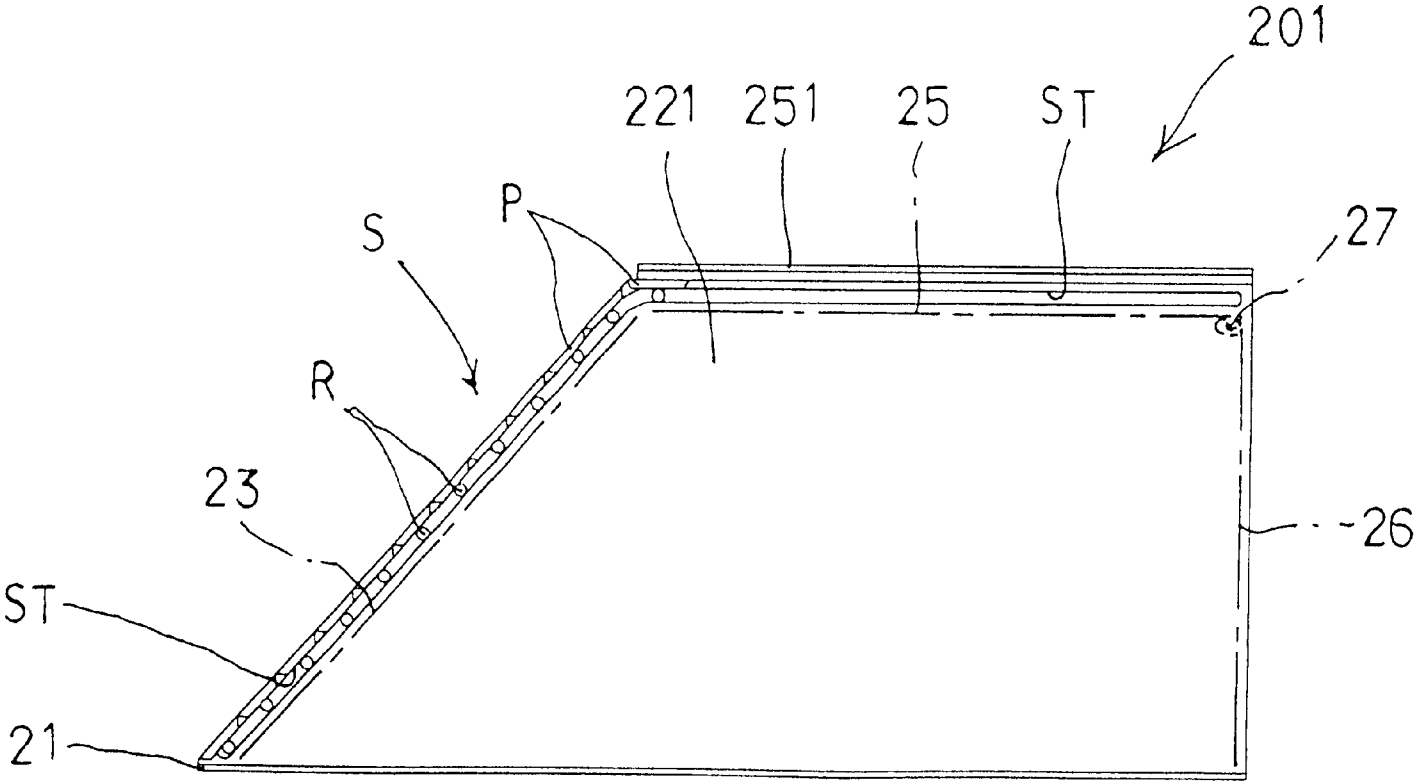
FIG. 9B is a sectional view which shows another cassette for paper money, which is stored inside of the paper money dispenser of FIG. 1.
Figure 10A:
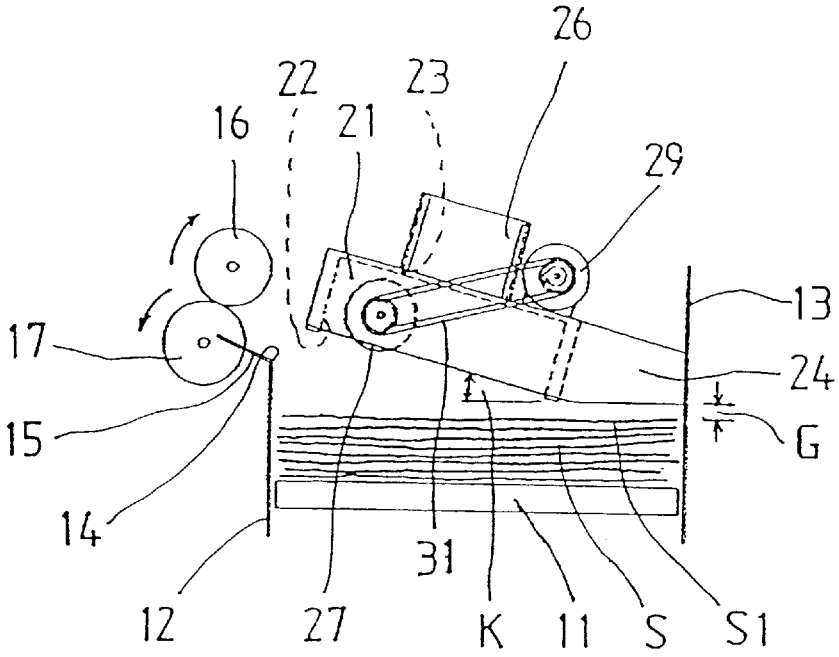
FIG. 10A is a schematic view of a known device.
Figure 10B:
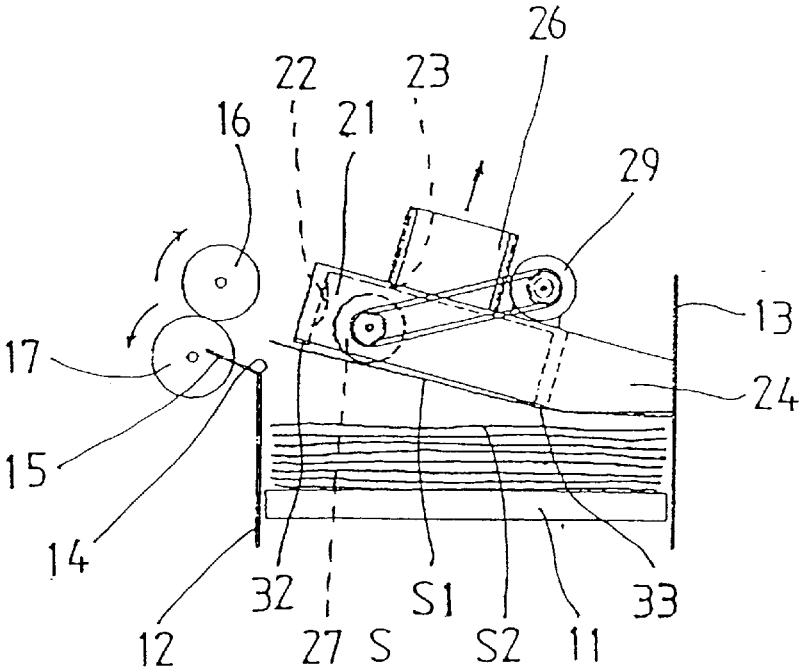
FIG. 10B is another schematic view of the device of FIG. 10A.
Figure 11A:
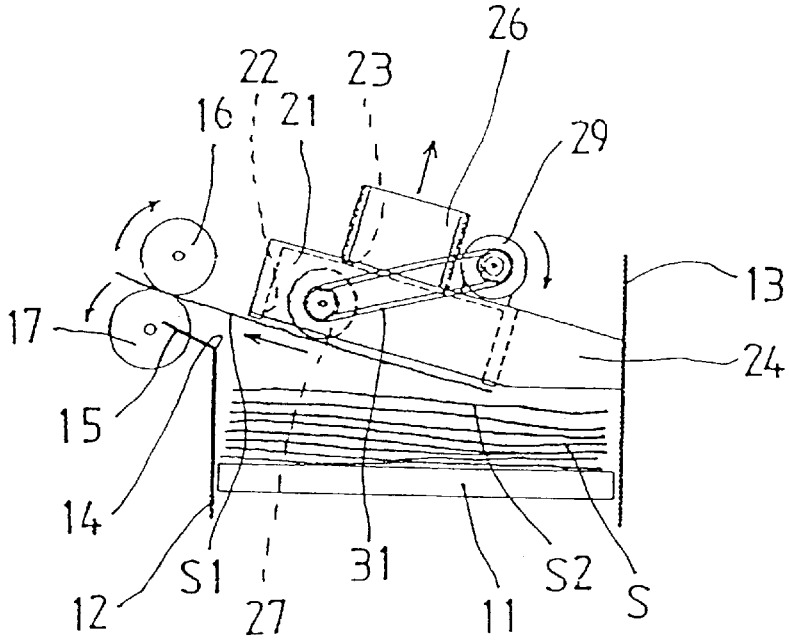
FIG. 11A is another schematic view of the device of FIG. 10A.
Figure 11B:
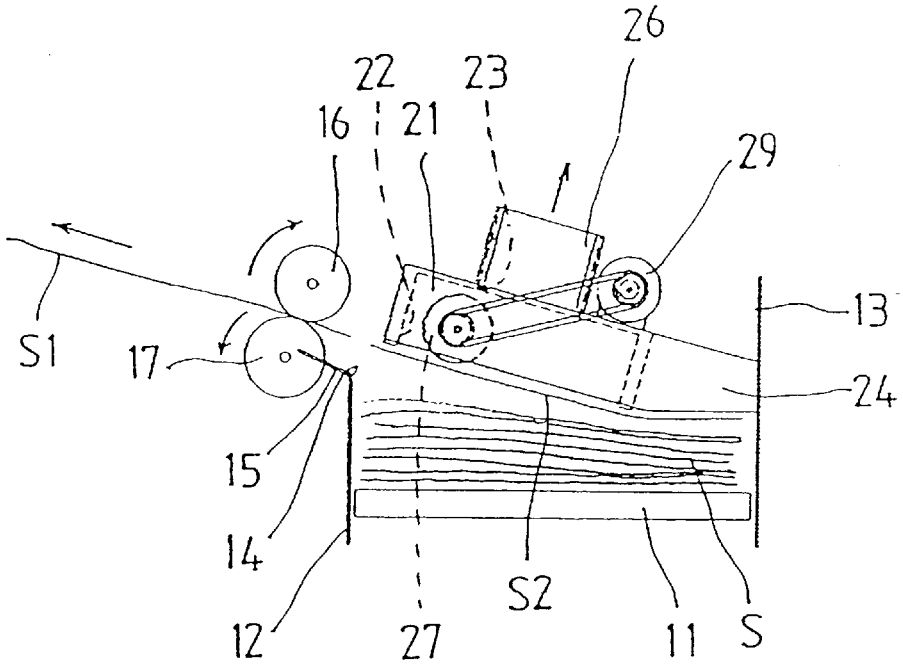
FIG. 11B is another schematic view of the device of FIG. 10A.

FIGS. 9A and 9B show a position where shutter S was closed. The opening 29 (not shown in FIGS. 9A and 9B) on window plate 23 is closed by shutter S. Still, by pulling shutter S up, opening 29 (not shown) is opened. At this time shutter S is contained between top plate 25 and cover plate 251.

As described above, by adding an arrangement which is simple in construction, this invention can perform to ensure paper money delivery. The sheet of paper money is issued with certainty. Especially, it is possible that this invention surely picks out only the top paper money from the stack, in which a plurality of paper money sheets are arranged.

While specific embodiments of the invention have been shown and described in detail to illustrate the application of the principles of the invention, it will be understood that the invention may be embodied otherwise without departing from such principles.

What is claimed is:

1. A paper money extraction device comprising:

a suction box having an opening defining a suction region for suctioning one paper money sheet;

a suction box drive arrangement for movement of the suction box about a pivot location, to move the suction box when the paper money sheet is taken up;

a driven roller arrangement for issuing paper money which is taken up on the suction box, the roller arrangement including a trailing sheet engagement roller disposed downstream of the suction region, with respect to a sheet feed direction.

2. A device according to claim 1, wherein said pivot location is the axis of said trailing sheet engagement roller.

3. A device according to claim 2, wherein said suction box has a fan for generating a suction force.

4. A paper money dispenser device comprising:

a paper money transfer mechanism a sheet extraction device with a suction box having an opening defining a suction region for suctioning one paper money sheet, a suction box drive arrangement for movement of the suction box about a pivot location when the paper money sheet is taken up, to move the suction box from a take up position to a transfer position with a portion of the sheet positioned for transfer and a driven roller arrangement for issuing paper money which is taken up on the suction box, the roller arrangement including a trailing sheet engagement roller disposed downstream of the suction region, with respect to a sheet feed direction.

5. A device according to claim 4, wherein said suction box has a fan for generating a suction force.

6. A device according to claim 4, further comprising a paper money sheet positioning structure for disposing a stack of paper money sheets at an angle relative to horizontal, wherein said drive moves said sheet from one angular position to another.

7. A device according to claim 6, wherein said pivot location is the axis of said trailing sheet engagement roller.

8. A feeder for feeding a sheet, the feeder comprising:

a suction box defining an air discharge opening and an air intake opening, said suction box having an opening edge around said air intake opening, said air intake opening and said opening edge having a size for sucking an almost whole portion of the sheet;

an air discharge fan arranged outside said suction box and arranged in communication with said discharge opening;

a driven roller arranged within said air intake opening, said roller being smaller than said air intake opening, said roller sending out the whole portion of the sheet which is adsorbed on said opening edge;

a shaft arranged at an end portion of said suction box, said suction box being rotatable about said shaft to move the portion of the sheet adsorbed on said opening edge;

said suction box is rotatable between a first and second position on said shaft.

9. A feeder in accordance with claim 8, wherein: said discharge opening is smaller than said air intake opening.

10. A feeder in accordance with claim 8, further comprising:

a cassette holding a plurality of sheets, said cassette having a cassette opening positioned adjacent said air intake opening of said suction box in said first position of said suction box on said shaft, said air intake opening sucking a sheet from said cassette through said cassette opening and moving the sheet away from said cassette by said suction box rotating about said shaft, said suction box being arranged on one side of said cassette.

11. A feeder in accordance with claim 8, further comprising: a trailing sheet engagement roller disposed downstream of said air intake-opening with respect to a sheet feed direction, said trailing sheet engagement roller feeding the sheet away from said suction box.

12. A feeder in accordance with claim 11, wherein:

said shaft and said trailing sheet engagement roller are substantially coaxial.

13. A feeder in accordance with claim 11, further comprising:

a motor driving said trailing sheet engagement roller.

14. A feeder in accordance with claim 10, further comprising:

a transfer mechanism arranged on another side of said cassette, said transfer mechanism receivable of the sheet from said suction box in said second position of said suction box, said transfer mechanism moving the sheet along said another side of said cassette to a dispensing mouth arranged substantially diametrically opposite said one side of said cassette.

15. A feeder in accordance with claim 14, further comprising:

a re-curving plate arranged at said dispensing mouth for selectively directing the sheet from said transfer mechanism into said cassette.

* * * * *